US005967743A

United States Patent [19]

Meylan

[11] Patent Number: 5,967,743

[45] Date of Patent: Oct. 19, 1999

[54] BLADE CARRIER FOR A COMPRESSOR

[75] Inventor: Pierre Meylan, Neuenhof, Switzerland

[73] Assignee: Asea Brown Boveri AG, Baden, Switzerland

[21] Appl. No.: 08/919,285

[22] Filed: Aug. 28, 1997

[30] Foreign Application Priority Data

Oct. 23, 1996 [DE] Germany ..... 196 43 716

[51] Int. Cl.[6] ..... F01D 25/08

[52] U.S. Cl. ..... 415/115; 415/116; 415/175

[58] Field of Search ..... 415/115, 116, 415/175, 176, 177, 178, 173.2, 173.1

[56] References Cited

U.S. PATENT DOCUMENTS

| | | | |
|---|---|---|---|
| 3,408,044 | 10/1968 | Burger | 415/176 |
| 3,478,689 | 11/1969 | Ball | 415/175 |
| 4,069,662 | 1/1978 | Redinger, Jr. et al. | 415/116 |
| 4,195,474 | 4/1980 | Bintz et al. | 415/176 |
| 4,230,436 | 10/1980 | Davison . | |
| 4,268,221 | 5/1981 | Monsarrat et al. | 415/116 |
| 4,301,650 | 11/1981 | Gubser et al. | 122/1 R |
| 4,386,885 | 6/1983 | Beckershoff . | |
| 4,431,371 | 2/1984 | Thomson | 415/116 |
| 4,632,635 | 12/1986 | Thoman et al. | 415/175 |
| 5,167,488 | 12/1992 | Ciokajlo et al. | 415/175 |
| 5,375,973 | 12/1994 | Sloop et al. . | |

FOREIGN PATENT DOCUMENTS

| | | |
|---|---|---|
| 649186 | 10/1964 | Belgium . |
| 0638727A1 | 2/1995 | European Pat. Off. . |
| 451857 | 11/1927 | Germany . |
| 1034193 | 7/1958 | Germany . |

*Primary Examiner*—Edward K. Look
*Assistant Examiner*—Richard Woo
*Attorney, Agent, or Firm*—Burns, Doane, Swecker & Mathis, L.L.P.

[57] ABSTRACT

A blade carrier for an axial-flow compressor is provided with cooling passages, through which a cooling medium flows in a closed circuit. The cooling passages run at least approximately in the peripheral direction inside the blade carrier and are located in a closed water circuit which essentially comprises a circulating pump (31), a pressure-keeping vessel (32) and a heat exchanger (35).

The cooling passages are arranged in a ring shape, each cooling ring (27) being provided with a feed line (28) and a discharge line (29). At least every second successive cooling ring is attached to a separate cooling path in the longitudinal direction of the blade carrier.

17 Claims, 2 Drawing Sheets

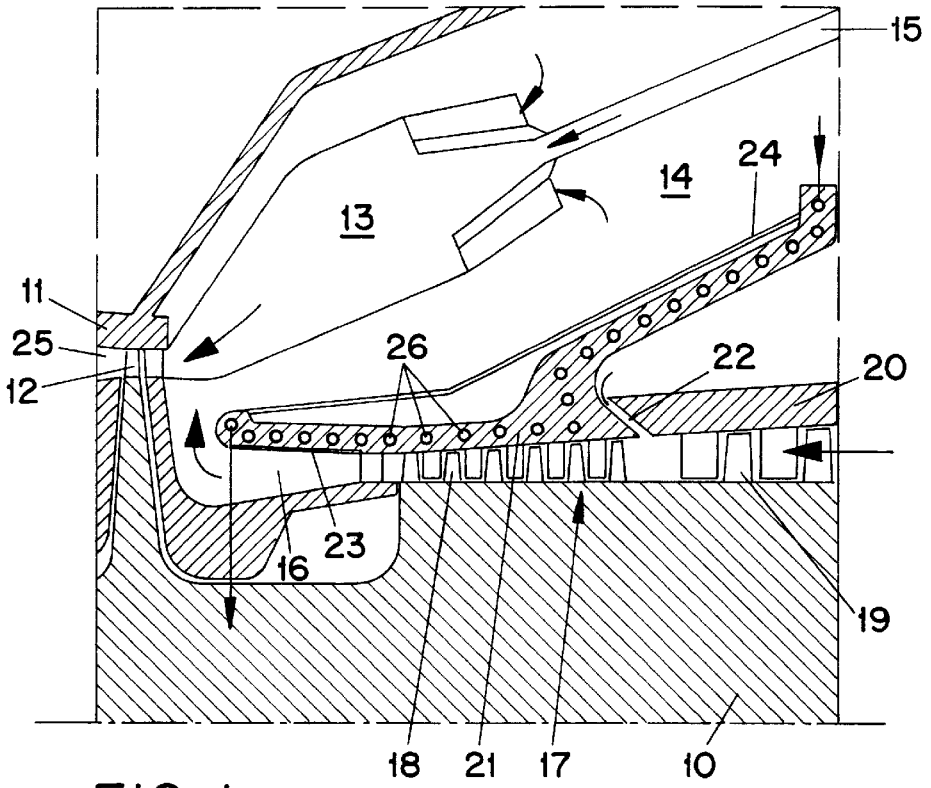
FIG. 1
FIG. 2
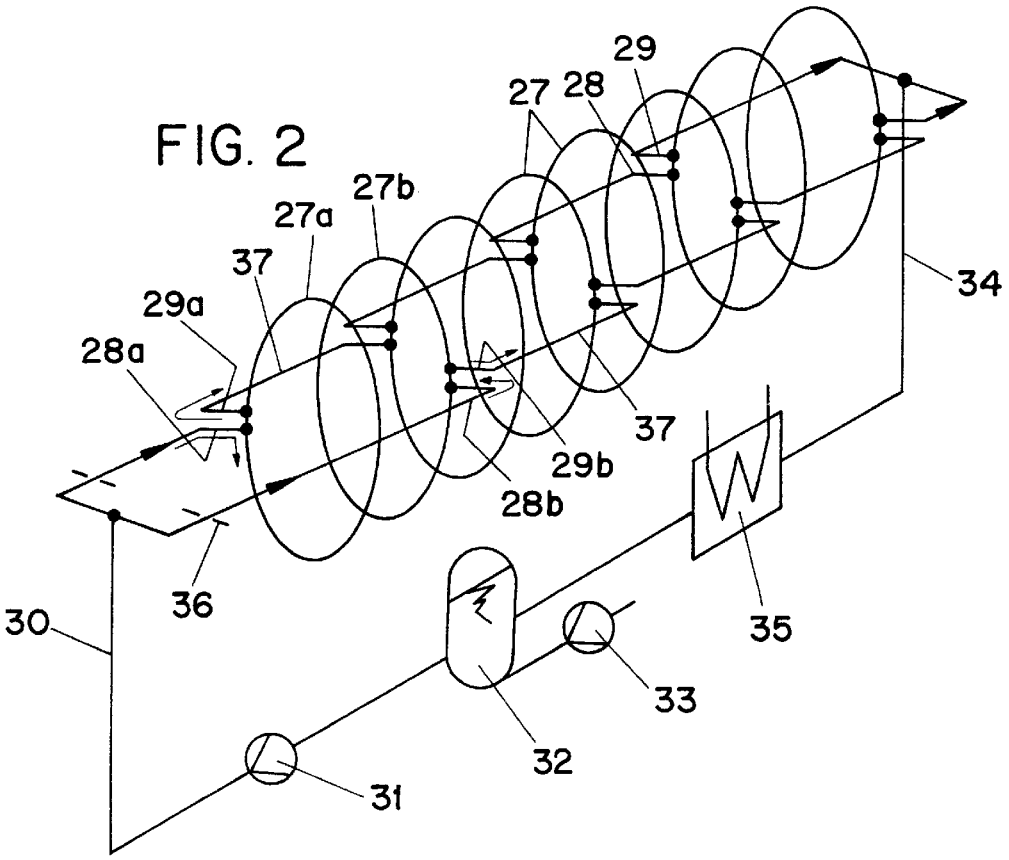

BLADE CARRIER FOR A COMPRESSOR

BACKGROUND OF THE INVENTION

1. Field of the Invention

The invention relates to a blade carrier for an axial-flow compressor, preferably a high-pressure compressor subjected to high thermal loading, the blade carrier being provided with cooling passages, through which a cooling medium flows in a closed circuit.

2. Discussion of Background

Cooled or heated blade carriers for turbomachines are sufficiently known. In order to solve the starting problems of a steam turbine, it is already known from BE-A 649 186 to arrange a system consisting of tubes, passages, lines and the like between the blade carrier and outer insulation and in a circular or spiral manner around the blade carrier in order to keep the latter at a desired temperature at all times by supplying external heat.

In axial compressors, in particular high-pressure compressors as well, as used, for example, in stationary gas turbines or turbine engines for compressing the combustion air, a radial clearance in the order of magnitude of 1 mm is provided between the outer ends of the moving blades and the inner wall of the compressor casing, which clearance is to be kept as small as possible so that the backflow of air and the reduction in the efficiency associated therewith can be kept slight. This correspondingly applies to the guide-blade tips, which provide a seal with respect to the rotor.

The reduction in the radial clearance is made more difficult by virtue of the fact that rotor blades and compressor casing expand or contract to a different degree in different operating states of the compressor. The radial clearance must therefore be selected in such a way that it is still adequate under the most unfavorable operating conditions, i.e., when rotor and moving blades have expanded and the compressor casing has contracted. It has to be taken into account here that the change in the radial clearance may have both mechanical and thermal causes. The mechanical cause may be in particular the radial deflection of the rotor and the moving blades caused by the centrifugal forces acting during high-speed rotation. Different thermal expansions in the rotor and stator on account of temperature differences or different coefficients of expansion of the materials used as well as the ovalization of the casing parts due to the joint in the parting plane may be regarded as thermal causes.

In the past, a multiplicity of proposals have been made which deal with the so-called active control of the radial clearance during operation. For this purpose, alternatively colder or warmer compressed air for example, which originates from different compression stages, can be directed into the interior of the rotor in order to control the radial clearance by controlling the temperature of the disks carrying the moving blades.

In addition to the abovementioned temperature control of the rotor, temperature control of the compressor casing has also already been proposed (U.S. Pat. No. 4,230,436), in which the temperature of the compressor casing is lowered in a controlled manner by a more or less intense cooling-air flow. In this case, the cooling air is bled at different compressor stages and passed along in cooling passages both behind the guide blades and behind the inner wall of the compressor casing opposite the moving blades.

The known methods for the active clearance control relate to the normal operation of the compressor. Therefore, for cooling or heating various compressor parts or sections, they may also resort to compressor air of varying temperature or—in the case of the compressor of a gas turbine—to hot gas from the engine part.

Here, the case of the so-called "hot start", during which the compressor starts again after a preceding shutdown but before it has completely cooled down, is not taken into account: in this case, the rotor and stator are at markedly different temperatures, since the outer stator cools down quicker and accordingly contracts, whereas the rotor remains hot for a longer period and accordingly retains its expansion. The radial clearance is thereby considerably reduced. So that renewed starting is possible in this state (hot start), this special case must be taken into account when dimensioning the radial clearance, a factor which leads to increased values of the radial clearance.

SUMMARY OF THE INVENTION

In modern gas turbines, the rotor may likewise be cooled and be made of ferritic material. As a rule, it is then provided with thermal insulation, which ensures that the rotor temperature remains lower than the temperature of the combustion air in the respective section at the compressor outlet. In this case, the radial operating clearances are greater than the clearances in the cold state of the plant, since the rotor temperature is lower than the temperature of the blade carrier.

Accordingly, one object of the invention, in attempting to remedy this, is to cool the blade carrier down to about 70 to 120° C. and thus subject it only to negligible thermal movement during all operating conditions. Consequently, only the mechanical and thermal movements of the rotor would have to be taken into account, and minimum radial clearances can be achieved under all operating conditions. The hot start in particular no longer forms a criterion for the correct choice of radial clearance.

According to the invention, this is achieved in a blade carrier of the type aforementioned in that the cooling passages run at least approximately in the peripheral direction inside the blade carrier and are located in a closed water circuit which essentially comprises a circulating pump, a pressure-keeping vessel and a heat exchanger. Water is suitable as the cooling medium; if need be, a cooling gas or high-pressure steam could also be considered as cooling medium.

The advantage of the invention may be seen, inter alia, in the fact that, for a blade carrier cooled down in such a way, a cost-effective and readily workable material such as nodular iron or gray iron can be used, in contrast to the expensive materials normally used today, such as 10-percent chromium steel for example. In addition, no ovalization takes place as a result of the low temperature of the blade carrier, and a virtually leakage-free structure is possible.

It is expedient if the cooling passages are arranged in a ring shape or helically and if each cooling ring is provided with a feed line and a discharge line, so that at least two separate cooling paths can be provided. It would then be suitable for at least every second successive cooling ring or at least every second successive loop of the helical arrangement to be attached to a separate cooling path in the longitudinal direction of the blade carrier.

If the cooling passages with their feed and discharge lines form a cohesive skeleton, the latter can be put into the casting mold of the blade carrier and be cast together with the blade carrier. It is certainly already known from U.S. Pat. No. 4,382,885 to integrally cast cooling passages in a blade carrier. However, this concerns the cooling of gas-turbine blades, for which purpose tubes running in the axial direction of the machine and communicating with the guide-blade roots are arranged in the blade carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a stationary gas turbine, wherein:

FIG. 1 shows a partial longitudinal section through the compressor of the gas turbine;

FIG. 2 shows a diagrammatic scheme of a cooling-passage arrangement;

DESCRIPTION OF THE PREFERRED EMBODIMENTS

Figure 3:
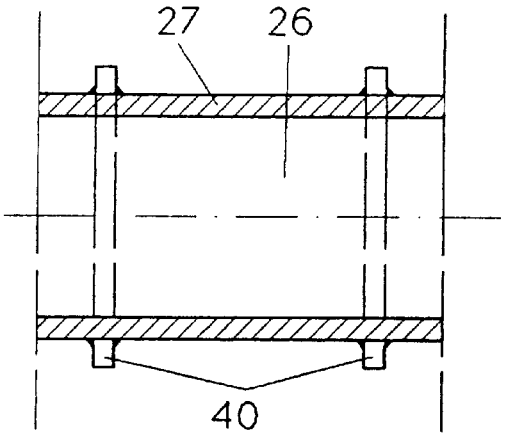
FIGS. 3 to 6 show exemplary embodiments of cooling tubes.

Referring now to the drawings, wherein like reference numerals designate identical or corresponding parts throughout the several views, only the elements essential for understanding the invention are shown, and the direction of flow of the working media is designated by arrows, FIG. 1 schematically shows a single-shaft gas turbine, which in the example is equipped with reheating. On the turbine side, the rotor 10 and the blade carrier 11 are fitted with single-stage high-pressure blading 12 or respectively multi-stage low-pressure blading (not shown). The flue gas flowing from the primary combustion chamber 13 expands in the high-pressure blading while delivering power and passes into a mixing section 25. There, further fuel and if need be, combustion air are admixed with the flue gas via a fuel feed and the mixture is fed to a second combustion chamber.

The primary combustion chamber 13 draws the combustion air from the plenum 14 and is supplied with liquid and/or gaseous fuel via the fuel line 15.

The combustion air passes into the plenum 14 from the diffuser 16 of the compressor 17. The multi-stage high-pressure blading 18 or respectively low-pressure blading 19 of the compressor 17 is formed by moving blades on the one hand, which are embedded in recesses in the rotor 10. On the other hand, the associated guide blades are fastened in recesses in the two-piece low-pressure blade carrier 20 and high-pressure blade carrier 21. A cooling-air bleed 22 is arranged between high-pressure blading 18 and low-pressure blading 19. To show the prevailing problem, it is assumed that the combustion air, as a result of the compression in the low-pressure blading, already has a temperature of about 450° C. at the outlet of the latter. It can be seen from FIG. 1 that the inside of the slanting part of the high-pressure blade carrier 21 is exposed to this temperature. In the high-pressure blading 18, the combustion air is compressed to its final pressure and in the process reaches a temperature of about 550° C., at which it is expelled via the diffuser 16 into the plenum 14. The entire outside of the high-pressure blade carrier 21 as well as its inner wall defining the diffuser is exposed to this outlet temperature.

In order to be able to use a cost-effective material for the blade carrier subjected to high thermal loading, a heat shield 23 is attached to the diffuser wall in a suitable manner. The outside of the blade carrier 21 is separated over its entire axial extent from the plenum 14 via thermal insulation 24 in the form of a cover plate. The blade carrier is likewise provided over its entire length with cooling passages 26, through which a cooling medium, here water, flows in a closed circuit. These cooling passages run in the peripheral direction inside the blade carrier and the flow through them takes place in parallel with the compressor flow.

FIG. 2 shows an example of an expedient cooling-passage arrangement. The passages are of ring-shaped design and consist of a plurality of cooling rings 27 arranged side by side at a suitable distance apart and having one feed line 28 each and one discharge line 29 each. The cooling rings 27 are fed via a water-supply line 30 by means of a circulating pump 31. The cooling water is drawn from a pressure-keeping vessel 32, which in turn is supplied with water by means of a pressure pump 33. A gas atmosphere is located above the water level in the pressure-keeping vessel. The water is drawn off from the respective last cooling rings via a water-return line 34 and is recooled in a heat exchanger 35 before it passes into the pressure-keeping vessel 32.

In the example, two separate cooling paths are provided, which are fed from the common water-supply line 30 and at the discharge from the cooling passages lead into the common water-return line 34. In order to uniformly supply the two paths with water, orifices 36 are arranged in each case upstream of the cooling rings 27 to which water is admitted first.

The cooling paths are designed in such a way that every second cooling ring of the arrangement lies in the same path. As can be seen from FIG. 2, the first ring 27*a* draws water from the left-hand feed line 28*a*. The water flows through the ring counterclockwise and is drawn off from the ring via the discharge line 29*a*. This discharge line 29*a* communicates with the feed line of the next cooling ring but one via a connecting line 37. Accordingly, the second ring 27*b* draws water from the right-hand feed line 28*b*. Here, the water flows through the ring clockwise and is drawn off from the ring via the discharge line 29*b*. This discharge line 29*b* communicates with the feed line of the next cooling ring but one again via a connecting line 37. In the longitudinal direction of the blade carrier, therefore, the flow through adjacent cooling passages takes place in the opposite direction.

It goes without saying that such a ring arrangement does not of course have to be purely cylindrical, as shown in FIG. 2, but that, according to the representation in FIG. 1, the cooling passages may also run radially one above the other or obliquely. The person skilled in the art will select the requisite distance between two adjacent rings on the basis of the heat to be dissipated locally in each case.

Irrespective of the actual geometry of the cooling arrangement, this solution has the advantage that all cooling rings 27 with their feed and discharge lines 28 and 29 respectively and the connecting lines 37 can be assembled to form a skeleton construction, for example by welding. This skeleton construction may subsequently be cast together with the blade carrier. Nodular iron, for example GGG40Mo, or gray iron are suitable as the material for the blade carrier. The cooling rings preferably consist of steel tubes having a higher melting point than that of the blade-carrier material. Due to the higher coefficient of thermal expansion of stainless steel, intimate contact and thus good heat exchange between blade carrier and cooling tubes is always ensured during operation.

Figure 4:
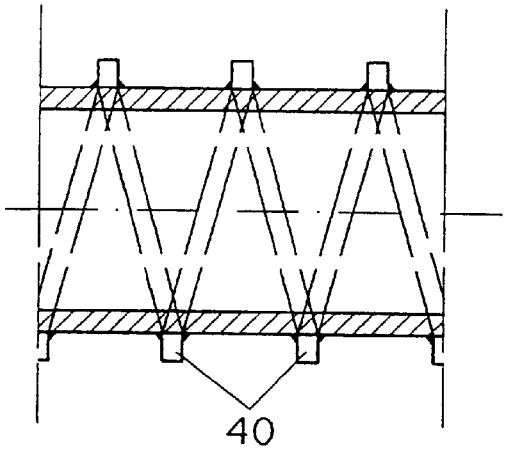
Figure 5:
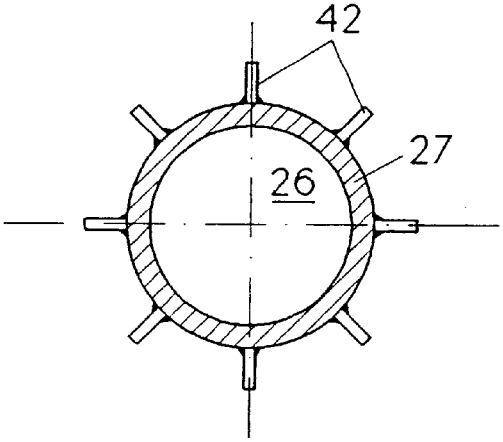
Figure 6:
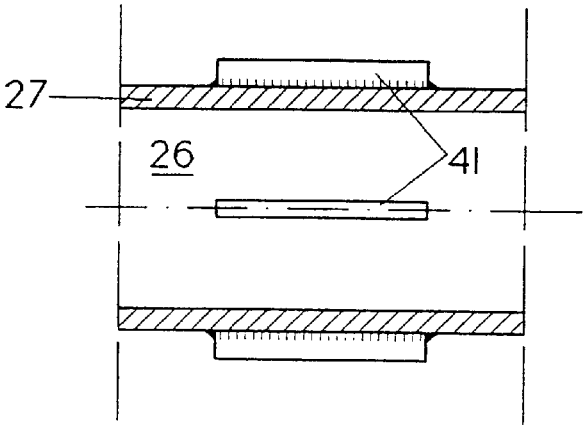

In order to encourage this heat exhange even further, the cooling tubes according to FIGS. 3 to 6 may be provided at their outer periphery with welded-on ribs 40, webs 41 or pins 42. In this case, the ribs may be arranged in a circular manner (FIG. 3) or a helical manner (FIG. 4). Longitudinally directed webs 41 (FIG. 6) and, in the same way, pins 42 (FIG. 5), may be attached to the tube periphery at several points.

A numerical example illustrates the mode of action of the invention: at a wall thickness of about 50 to 70 mm of the blade carrier to be cooled, steel tubes of 20 mm outside diameter are selected. The thermal insulation of the blade carrier is dimensioned in such a way that the temperature difference between the outside and inside of the blade carrier is not to be greater than 30–70° C. The heat transfer occurring by convection between combustion air and blade carrier is to be limited to 50–150 $W/m^2K$. In the case of a blade carrier of a modern plant, the result of this is that a heat quantity of about 500 kW is to be dissipated via the closed water-cooling circuit. If a temperature difference of 20° C. between water inlet and water outlet is permitted, this requires a water quantity of 6 kg/sec. It is advisable for this purpose to work with a water pressure of 40 to 80 bar and a water temperature of at most 120° C.

Another cooling-passage arrangement (not shown) may consist in the fact that the cooling passages are arranged helically and that here, too, at least two separate cooling paths are provided. This solution corresponds to a double-start thread. Every second successive loop of the helical arrangement would then also be attached to a separate cooling path by means of separate feed and discharge lines.

Figure 7:
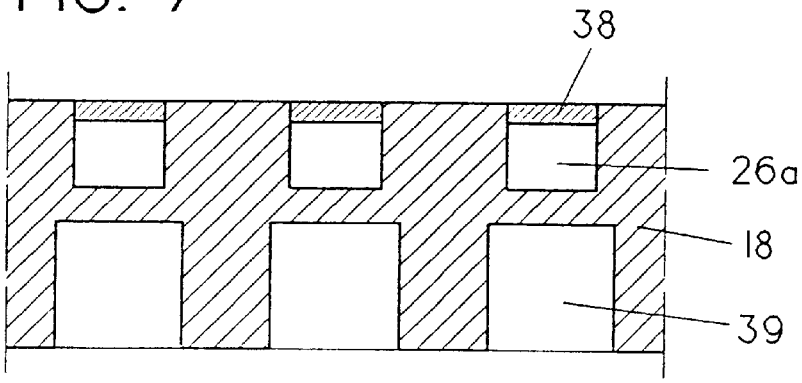
FIG. 7 shows a variant of a cooling-passage arrangement.

A further cooling-passage arrangement shown in FIG. 7 may consist in the fact that the cooling passages 26*a* are made in the outer wall of the blade carrier by milling or turning and are closed with a welded-on shroud band 38. In this solution, too, a circular or helical passage arrangement may be used. In this case, the feed and discharge lines of the individual passages and the connecting lines would be located outside the actual blade carrier. A low-alloy steel would then be suitable as the material for the blade carrier. The recesses made in the inner wall of the blade carrier and intended for the compressor moving blades are designated by 39.

The invention is of course not restricted to the embodiment shown and described. Unlike the specified direction of flow, the flow through the cooling passages could also take place in counterflow to the compressor flow. Likewise, a flow through all cooling passages in the same direction either clockwise or counterclockwise is also not outside the scope of the invention. Depending on the size of the blade carrier to be cooled, a plurality of cooling paths may of course also be provided instead of the two paths described. The correct choice will, inter alia, be a question of the permissible pressure loss inside the cooling system.

Finally, the novel cooling method can be used not only in stationary gas turbines but also, for example, in lightweight aircraft turbines. In this case, an aluminum or magnesium alloy will be used as the material for the blade carrier to be cooled.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A blade carrier for an axial-flow compressor comprising:

a blade carrier;

a closed cooling medium circuit including a circulating pump, a pressure vessel, a heat exchanger, and a cooling medium flowing therethrough;

cooling passages in said closed cooling medium circuit formed in said blade carrier and through which said cooling medium flows in said closed circuit, said cooling passages running at least in the peripheral direction inside said blade carrier.

2. The blade carrier as claimed in claim 1, wherein said cooling passages comprises at least one cooling ring including a feed line and a discharge line.

3. The blade carrier as claimed in claim 2, wherein said feed line and said discharge line of said cooling passages are connected in said closed cooling medium circuit so that the flow of cooling medium through adjacent cooling passages takes place in opposite directions.

4. The blade carrier as claimed in claim 3, wherein said closed cooling medium circuit comprises a cooling medium supply line, and said cooling passages comprise a plurality of cooling paths, and further comprising an orifice in said cooling medium supply line.

5. The blade carrier as claimed in claim 2, wherein at least every second successive cooling ring is attached to a separate cooling path in the longitudinal direction of the blade carrier.

6. The blade carrier as claimed in claim 2, wherein said cooling passages with their feed and discharge lines form a cohesive skeleton which is cast with said blade carrier.

7. The blade carrier as claimed in claim 2, wherein said blade carrier includes an outer wall and a welded-on shroud band, said cooling passages being formed in said outer wall of said blade carrier and being closed with said welded-on shroud band.

8. The blade carrier as claimed in claim 1, wherein said cooling passages comprises at least one helical cooling passage.

9. The blade carrier as claimed in claim 8, wherein said at least one helical cooling passage comprises two separate helical cooling passages.

10. The blade carrier as claimed in claim 3, wherein said feed line and said discharge line of said cooling passages are connected in said closed cooling medium circuit so that the flow of cooling medium through adjacent cooling passages takes place in opposite directions.

11. The blade carrier as claimed in claim 10, wherein said closed cooling medium circuit comprises a cooling medium supply line, and said cooling passages comprise a plurality of cooling paths, and further comprising an orifice in said cooling medium supply line.

12. The blade carrier as claimed in claim 8, wherein at least every second successive loop of the at least one helical cooling passage is attached to a separate cooling path in the longitudinal direction of the blade carrier.

13. The blade carrier as claimed in claim 8, wherein said cooling passages with their feed and discharge lines form a cohesive skeleton which is cast with said blade carrier.

14. The blade carrier as claimed in claim 8, wherein said blade carrier includes an outer wall and a welded-on shroud band, said cooling passages being formed in said outer wall of said blade carrier and being closed with said welded-on shroud band.

15. The blade carrier as claimed in claim 1, wherein said cooling passages include outer walls having ribs, webs, or pins.

16. The blade carrier as claimed in claim 1, wherein said cooling medium flows through said cooling passages parallel with the compressor flow.

17. The blade carrier as claimed in claim 1, wherein said cooling medium comprises liquid water.

* * * * *